US007090320B2

(12) United States Patent
Chen et al.

(10) Patent No.: US 7,090,320 B2
(45) Date of Patent: Aug. 15, 2006

(54) COUPLING STRUCTURE FOR A SLIDING TRACK AND A MOUNTING BRACKET

(75) Inventors: Ken-Ching Chen, Kaohsiung Hsien (TW); Ting-Tsai Huang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/819,144

(22) Filed: Apr. 7, 2004

(65) Prior Publication Data

US 2005/0225219 A1 Oct. 13, 2005

(51) Int. Cl.
*A47B 88/04* (2006.01)

(52) U.S. Cl. ..... 312/334.5

(58) Field of Classification Search ..... 312/330.1, 312/334.1, 334.4, 334.5, 334.7; 16/94 R; 248/225.11, 231.9, 220.21, 220.31, 220.41, 248/220.42, 220.43; 403/353
See application file for complete search history.

(56) References Cited

U.S. PATENT DOCUMENTS 4,244,546 A * 1/1981 Mertes et al. ..... 248/258
5,039,181 A * 8/1991 Lautenschlager ..... 312/334.7
5,257,861 A 11/1993 Domenig et al.
5,387,033 A 2/1995 Domenig
5,549,376 A * 8/1996 Domenig ..... 312/334.5
5,636,820 A 6/1997 Domenig
5,727,858 A * 3/1998 Shapiro ..... 312/348.6
5,746,490 A 5/1998 Domenig
5,823,648 A 10/1998 Domenig
6,142,892 A * 11/2000 Dennis ..... 473/494
6,302,502 B1 10/2001 Larsen, Jr.
6,367,900 B1 * 4/2002 Woerner ..... 312/334.5
6,494,550 B1 * 12/2002 Chen et al. ..... 312/334.5

FOREIGN PATENT DOCUMENTS

DE 4124535 * 1/1993

* cited by examiner

*Primary Examiner*—James O. Hansen
(74) *Attorney, Agent, or Firm*—Birch, Stewart, Kolasch & Birch, LLP

(57) ABSTRACT

A coupling structure for a sliding track and a mounting bracket includes a rear mounting plate and a frame shell. The frame shell has a front opening end which has one side forming a guiding notch. The front opening end further has an upper and a lower retaining flange on the upper edge and a lower edge, which form respectively a ramp at one end adjacent to the guiding notch. The upper retaining flange has a slit formed at another end so that the upper retaining flange becomes flexible and elastic to facilitate pressing of the sliding track. The sliding track has a retaining plate on the rear end to form an upper flange and a lower flange extending outside the sliding track. The flanges may slide transversely through the guiding notch to allow the sliding track to enter the frame shell and be moved longitudinally inwards for positioning.

4 Claims, 7 Drawing Sheets

COUPLING STRUCTURE FOR A SLIDING TRACK AND A MOUNTING BRACKET

FIELD OF THE INVENTION

The present invention relates to a coupling structure for a sliding track and a mounting bracket and particularly to a novel design to achieve a secured coupling between a mounting bracket and the rear end of a sliding track without separation.

BACKGROUND OF THE INVENTION

Conventional drawer sliding tracks generally include a mounting bracket to facilitate user DIY assembly and fast installation. References can be found in U.S. Pat. Nos. 5,257,861, 5,387,033, 5,636,820, 5,746,490, and 5,823,648. Some of them include a mounting bracket with an integrated flange or stop member to retain the rear end of the sliding track so that the sliding track may be moved within a limited range without slipping away when subjected to external forces. Some others have bent plates fastened to the mounting bracket to achieve the same result.

Another example is a mounting bracket A made from plastics as shown in FIG. 1 (also referring to U.S. Pat. No. 6,302,502). The mounting bracket A mainly has a mounting plate A1 and a formed shell A2 at the front side to receive the rear end of a sliding track B. The shell has an interior space of a desired width allowing the insert end of the sliding track B to move transversely within a limited range. The shell A2 also has a tab A3 on the upper edge of the opening end that is extended slightly downwards and a sloped ramp A4 on the lower edge to aid the rear end of the sliding track B to enter the shell. The tab A3 on the upper edge can press the sliding track B to form a compressed coupling.

However, the compressed coupling between the tab A3 and the sliding track B cannot withstand great external forces. The sliding track B might separate and break away under external forces. This is especially true when the sliding track B is located in the shell A2 at a short distance. Therefore, there is still a need for an improved design to prevent the sliding track from being separated from the mounting bracket.

SUMMARY OF THE INVENTION

In view of the problems set forth above, the object of the invention is to provide a coupling structure for a sliding track and a mounting bracket so that the rear end of the sliding track may be coupled in the mounting bracket more securely without slipping away.

In one aspect of the invention, the mounting bracket has a frame shell with a guiding notch formed on one side of a front opening end thereof. The front opening end further has respectively a retaining flange on the upper edge and the lower edge. The two retaining flanges have respectively a ramp on one side adjacent to the guiding notch. The upper retaining flange further has a slit on another side so that the upper retaining flange is flexible to provide an elastic force to press the sliding track. The sliding track has a retaining plate at the rear end, to couple with the mounting bracket. The retaining plate has a jutting flange on the upper side and the lower side to wedge in and slide through the guiding notch transversely into the frame shell, then may be moved longitudinally into the frame shell for positioning.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
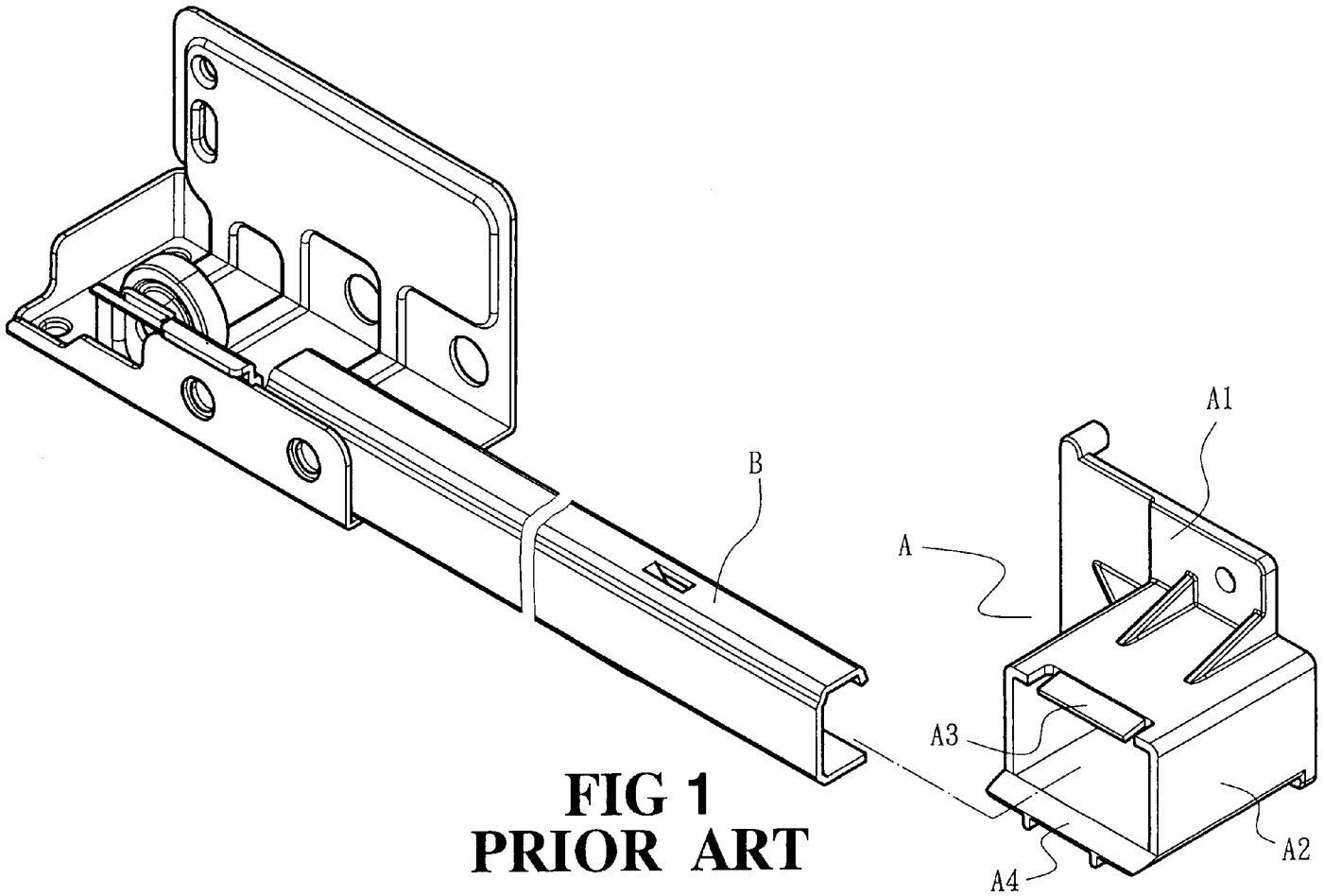
FIG 1 PRIOR ART
FIG. 1 is a schematic view of the structure of a conventional mounting bracket and sliding track.
Figure 2:
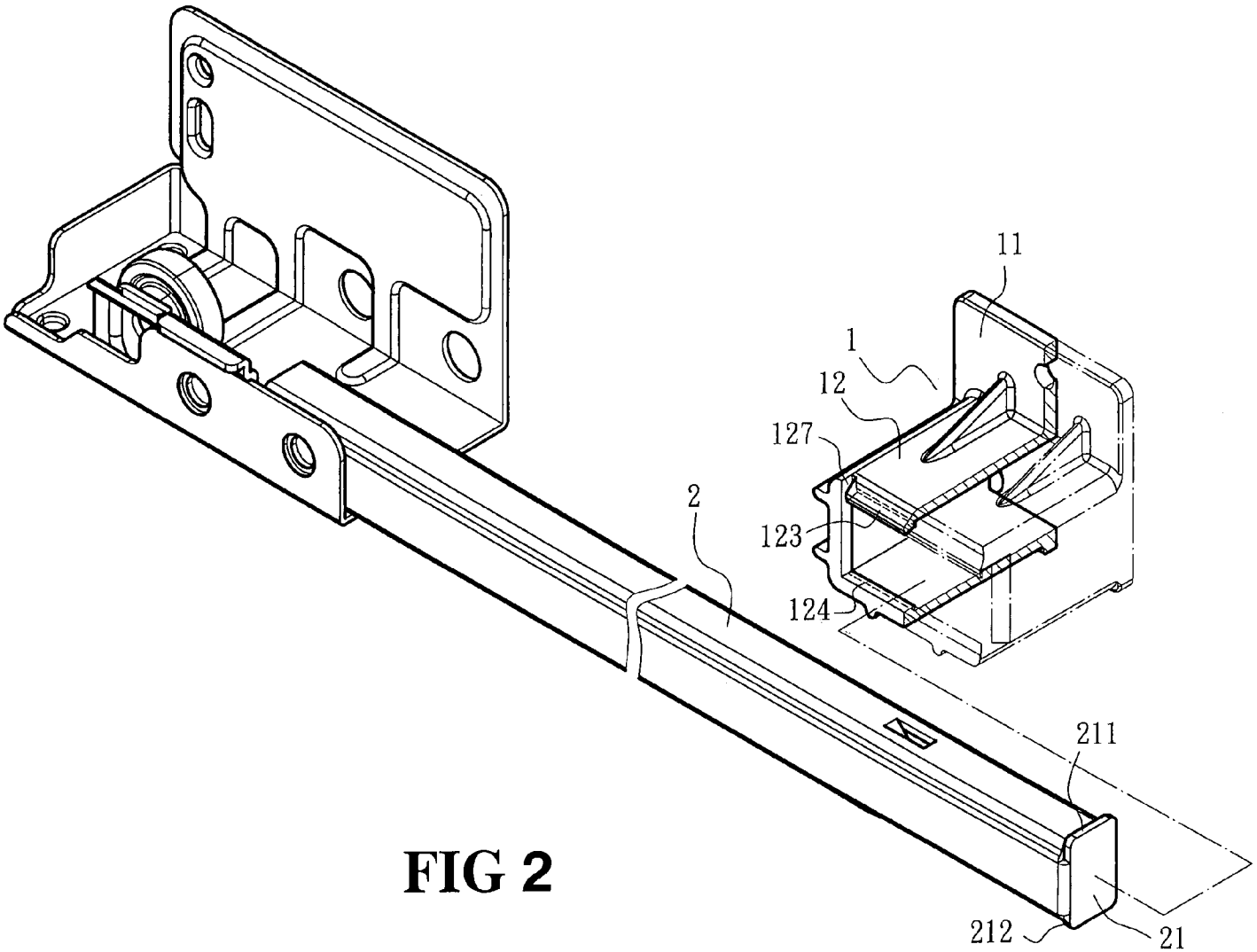
FIG. 2 is a schematic view of an embodiment of the invention.

Referring to FIG. 2, the mounting bracket 1 employed in the present invention mainly includes a rear mounting plate 11 and a frame shell 12.

Figure 3:
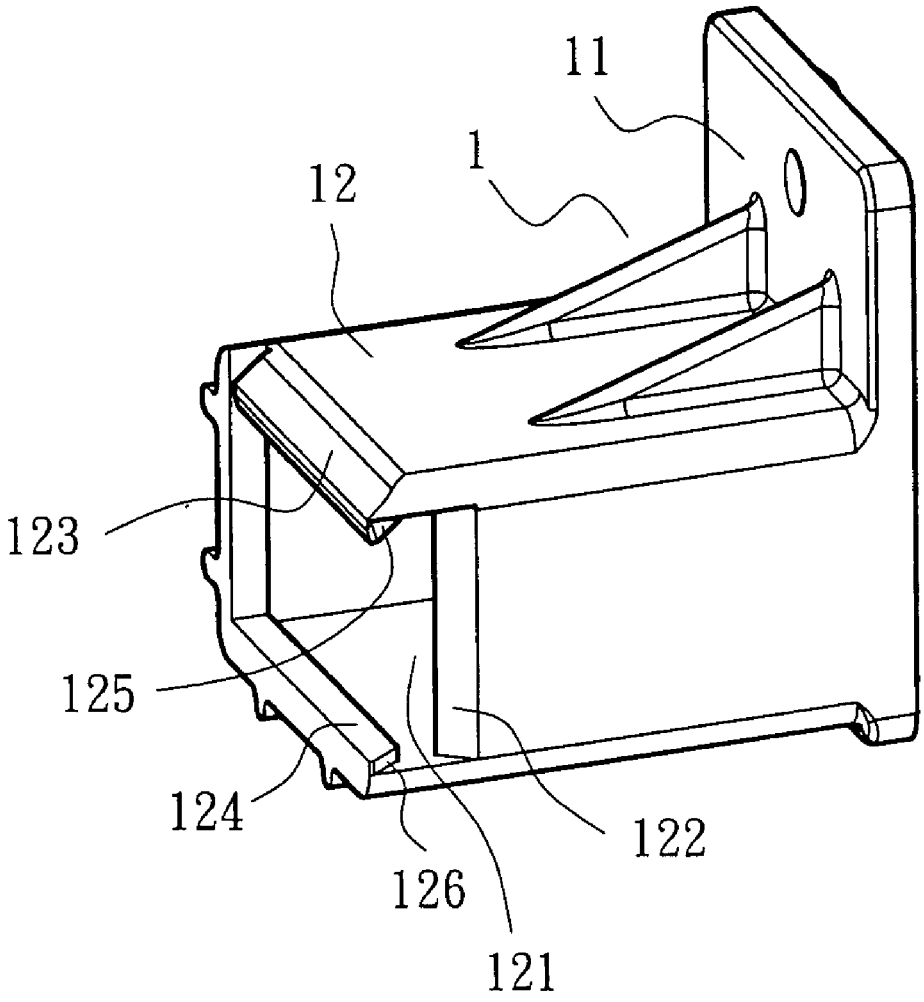
FIG. 3 is a perspective view of an embodiment of the mounting bracket of the invention.

Referring to FIG. 3, the frame shell 12 has a front opening end. On one side of the front opening end there is a guiding notch 121. The sidewall of the frame shell 12 adjacent to the guiding notch 121 has a vertical edge at the front side forming a sloped guiding surface 122. The upper edge and the lower edge of the front opening end of the frame shell 12 have respectively an upper retaining flange 123 and a lower retaining flange 124. The upper retaining flange 123 and the lower retaining flange 124 have one end abutting the guiding notch 121, forming respectively an upper ramp 125 and a lower ramp 126. The upper retaining flange 123 has another end, forming a slit 127, also see FIG. 2, so that the upper retaining flange 123 is flexible to provide an elastic force to press a sliding track 2. The sloped guiding surface 122, the upper ramp 125 and the lower ramp 126 are optional features of the invention to facilitate insertion of a retaining plate 21 on the rear end of the sliding track 2. The retaining plate 21 may be wedged into the frame shell by sliding through the guiding notch 121 without the sloped guiding surface 122, the upper ramp 125 and the lower ramp 126.

The structure of the sliding track 2 mates the mounting bracket 1. The retaining plate 21, located on the rear end thereof, has respectively an upper flange 211 and a lower flange 212 extended from the track. It is to be noted that extending the track by stamping may form the retaining plate 21. It also may be formed by soldering a metal plate on the rear end of the sliding track 2 (not shown in the drawing).

Figure 4:
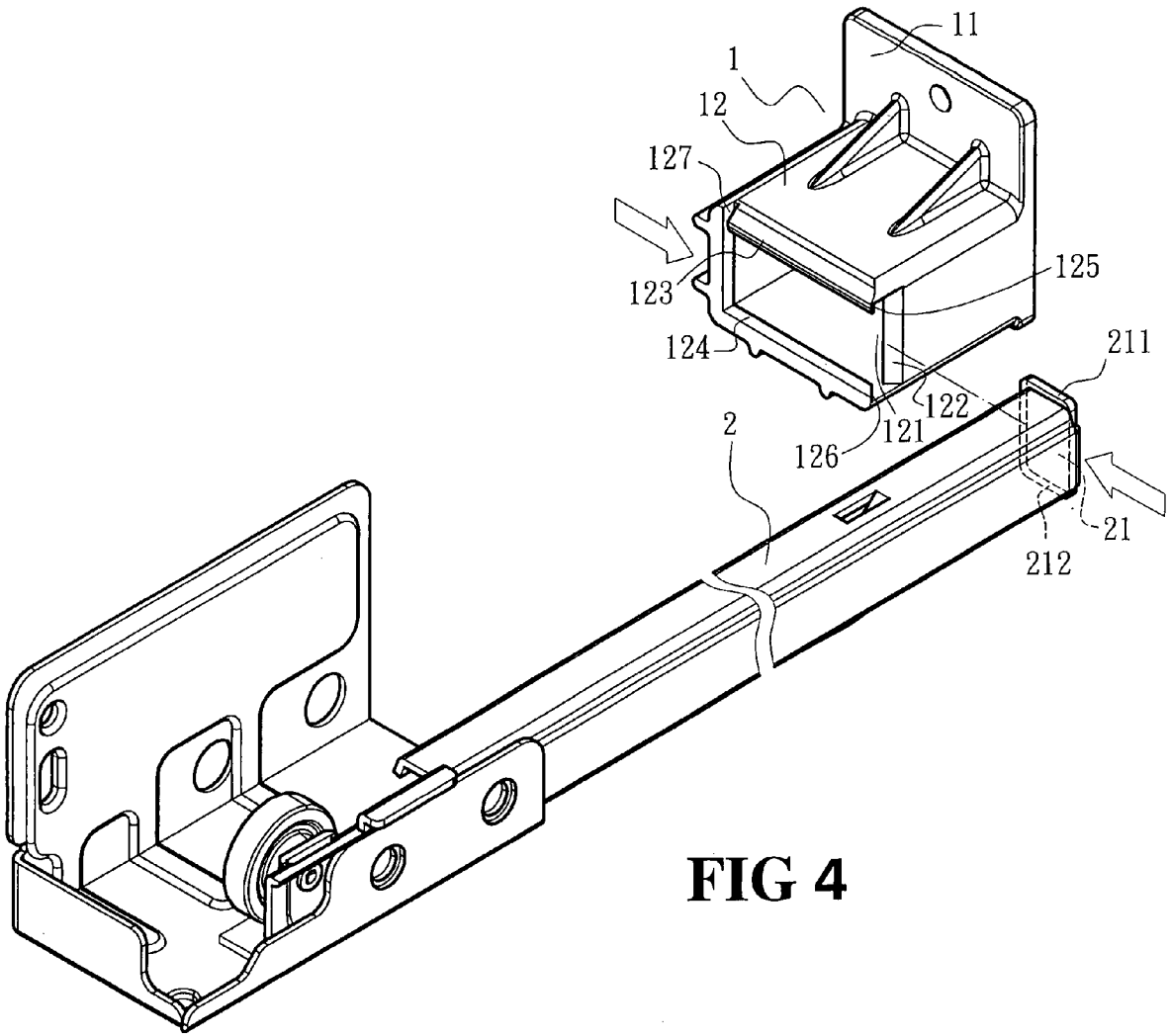
FIG. 4 is a schematic view of an embodiment of the invention in coupling operation-1.
Figure 5:
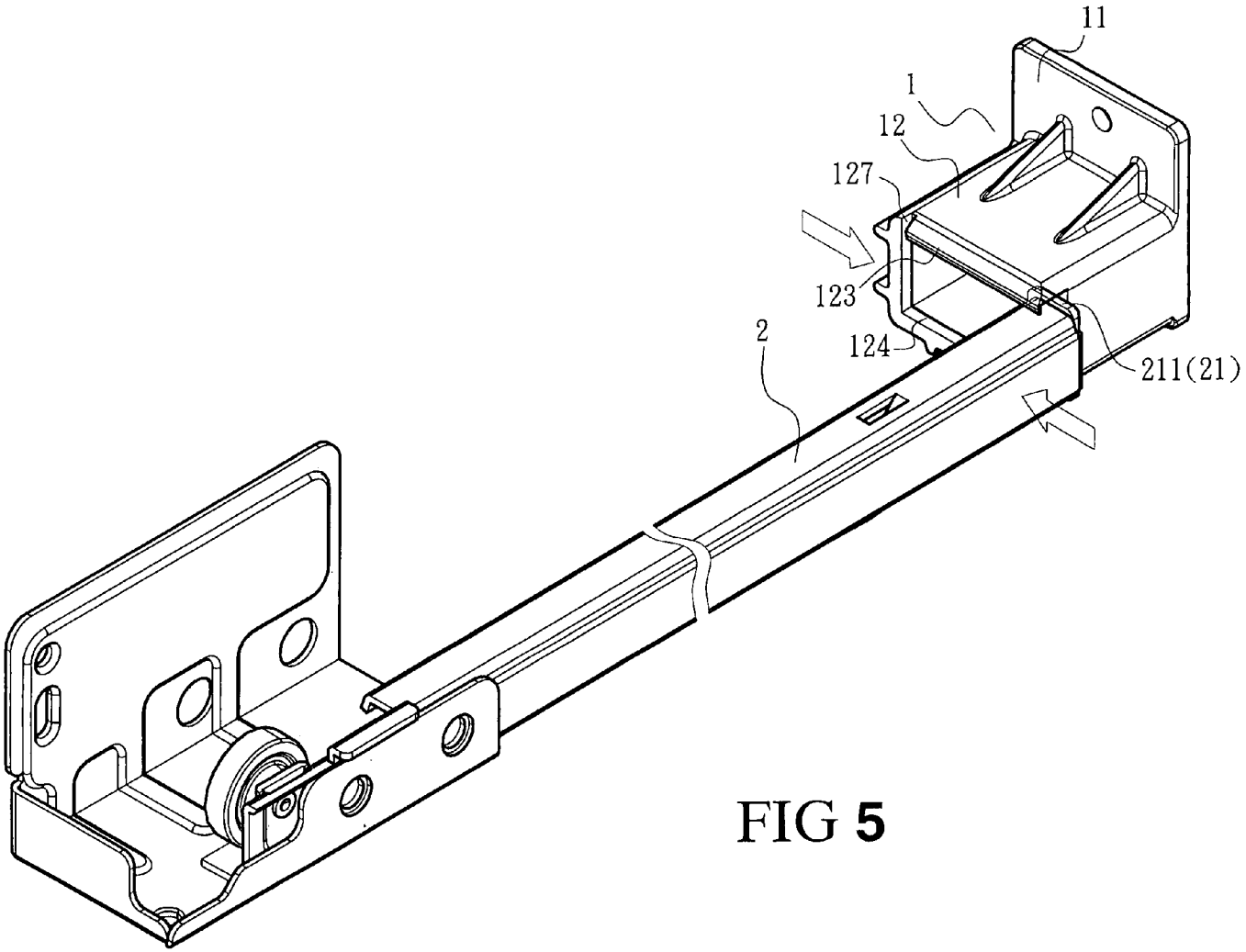
FIG. 5 is a schematic view of an embodiment of the invention in coupling operation-2.
Figure 6:
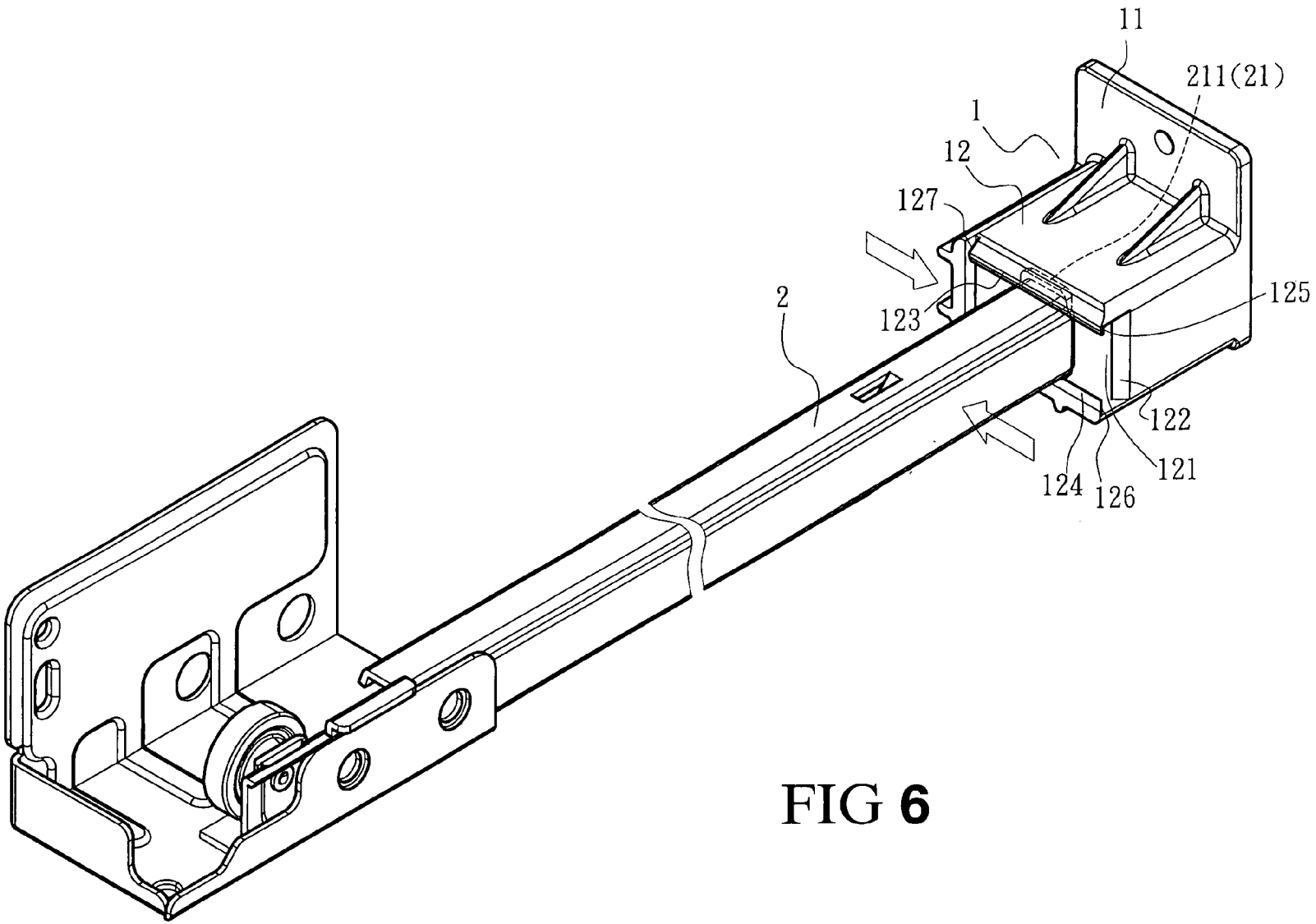
FIG. 6 is a schematic view of an embodiment of the invention in coupling operation-3.
Figure 7:
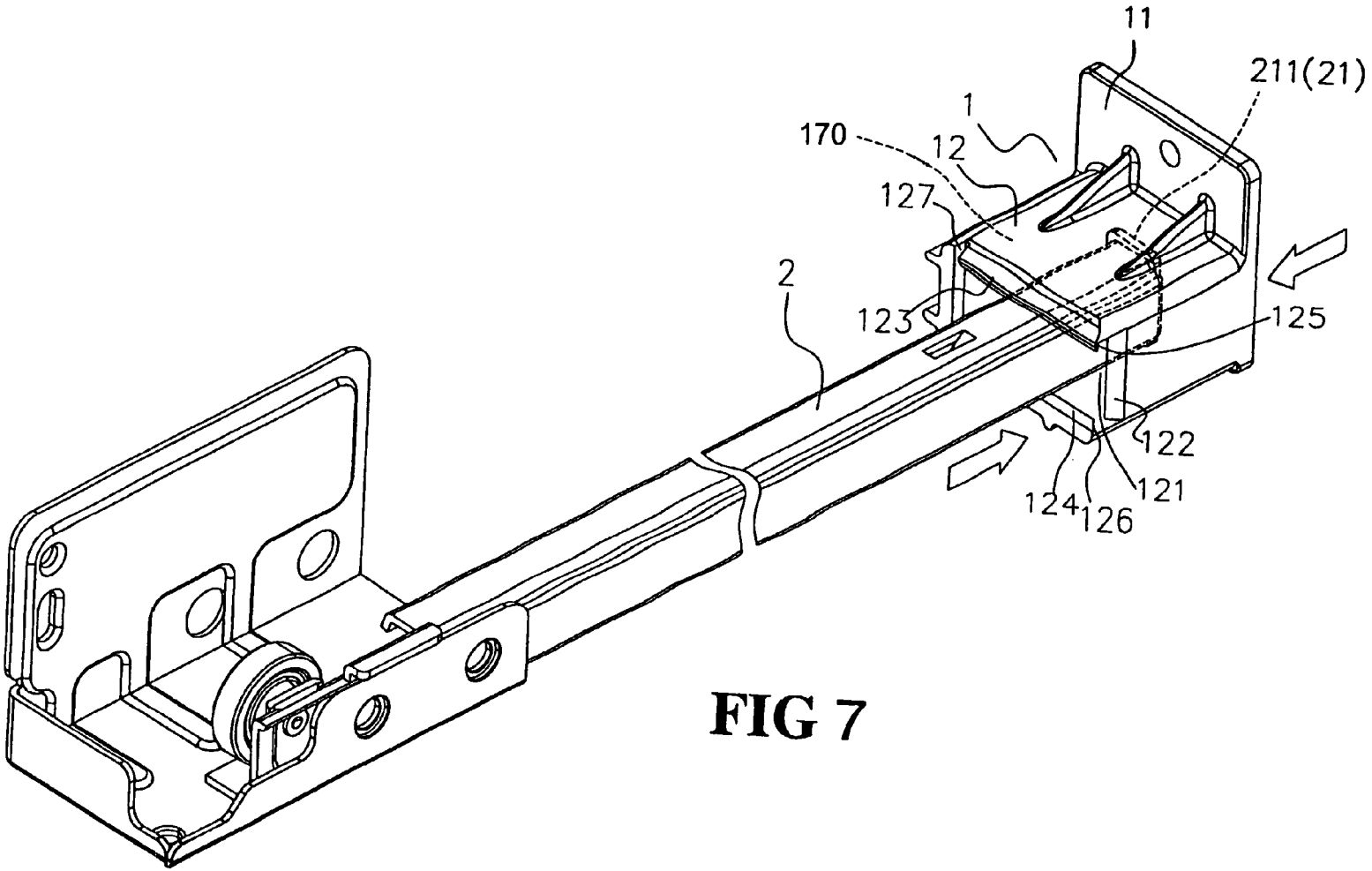
FIG. 7 is a schematic view of an embodiment of the invention in coupling operation-4.

For assembly of the sliding track 2 and the mounting bracket 1, referring to FIGS. 4 and 5, wedge and slide transversely the upper flange 211 and the lower flange 212 of the retaining plate 21 of the sliding track 2 through the guiding notch 121 into the frame shell 12 and move the sliding track 2 to the inner edge of the front opening of the frame shell (referring to FIG. 6) to be in contact with the inner side of the upper retaining flange 123 and the lower retaining flange 124 (as shown in FIG. 7); then push the sliding track 2 longitudinally inwards into the hollow portion 170 of the frame shell 12. The slit 127 enables the upper retaining flange 123 to provide an elastic force on the sliding track 2 so that the insertion may be performed steadily. The flanges 211 and 212 at the rear end of the sliding track 2 are stopped by the upper and lower retaining flanges 123 and 124, therefore the sliding track 2 cannot escape the mounting bracket 1 even under the impact of external forces. Thus the construction set forth above can prevent the sliding track from slipping away from the mounting bracket.

What is claimed is:

1. A coupling structure for sliding tracks and mounting brackets, comprising:

a sliding track having a retaining plate located on a rear end thereof, the retaining plate having an upper flange and a lower flange extending outside the sliding track; and a mounting bracket including a rear mounting plate and a frame shell that are integrally formed, the frame shell having a front opening end which has a guiding notch on one side, an upper retaining flange on an upper edge and a lower retaining flange on a lower edge thereof, the upper flange and the lower flange of the sliding track being slidable through the guiding notch in a transverse direction perpendicular to a direction of a normal of the rear mounting plate, the frame shell having a hollow portion extending along the direction of the normal of the rear mounting plate beyond the guiding notch to the rear mounting plate to allow the sliding track to move along the direction of the normal of the rear mounting plate into the hollow portion of the frame shell for positioning;

wherein the upper retaining flange has one end abutting the guiding notch and another end having a slit to allow the upper retaining flange to be elastic and flexible.

2. The coupling structure of claim 1, wherein the frame shell has a side wall adjacent to the guiding notch, the side wall having a vertical edge at a front side thereof, the vertical edge forming a sloped guiding surface.

3. The coupling structure of claim 1, wherein the retaining flanges have respectively one end forming an upper ramp and a lower ramp adjacent to the guiding notch.

4. The coupling structure of claim 1, wherein the retaining plate is selectively formed by extending the sliding track made of metal and bent by stamping, or a metal plate of a selected size fastened to the rear end of the sliding track by soldering.

* * * * *